United States Patent [19]

Clark

[11] Patent Number: 4,536,910

[45] Date of Patent: Aug. 27, 1985

[54] SPATULA TYPE HAND TOOL

[76] Inventor: Ronald M. Clark, 105 Factory, Addison, Ill. 60101

[21] Appl. No.: 357,724

[22] Filed: Mar. 12, 1982

[51] Int. Cl.[3] ..... B05C 17/10

[52] U.S. Cl. ..... 15/104 S; 15/236 R; 30/169

[58] Field of Search ..... 15/104 S, 236 R, 245; 7/105; 30/169, 328, 348; D32/46, 48, 49

[56] References Cited

U.S. PATENT DOCUMENTS

D. 156,638 12/1949 Lifshutz et al. ..... D32/49
1,554,387 9/1925 Thomson ..... 15/236 R
2,719,316 10/1955 Hauser ..... 15/236 R
2,770,826 11/1956 Curfman ..... 15/245 X
3,214,834 11/1965 Bell ..... 15/236 R X

FOREIGN PATENT DOCUMENTS 827107 1/1952 Fed. Rep. of Germany .... 15/236 R

*Primary Examiner*—Edward L. Roberts
*Attorney, Agent, or Firm*—Robert F. Van Epps

[57] ABSTRACT

A spatula type hand implement having integrally formed handle and blade portions and a compound curved reinforcing blister molded therein along the longitudinal axis across the transition between the handle and blade portions.

6 Claims, 9 Drawing Figures

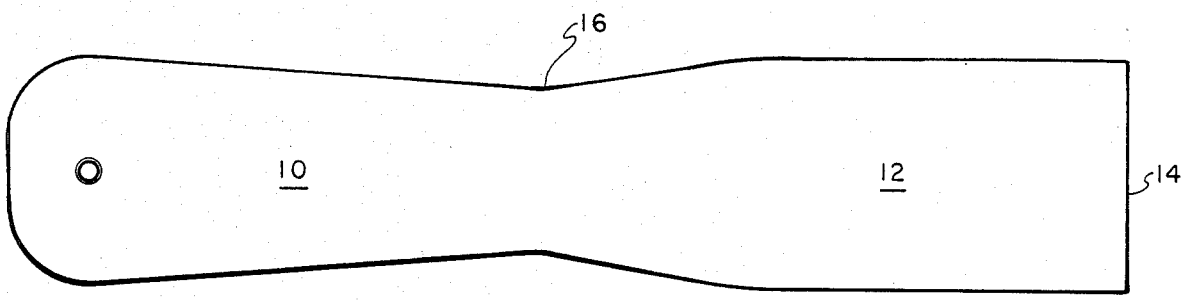
FIG. 1A - PRIOR ART
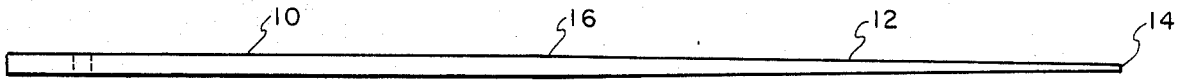
FIG. 1B - PRIOR ART
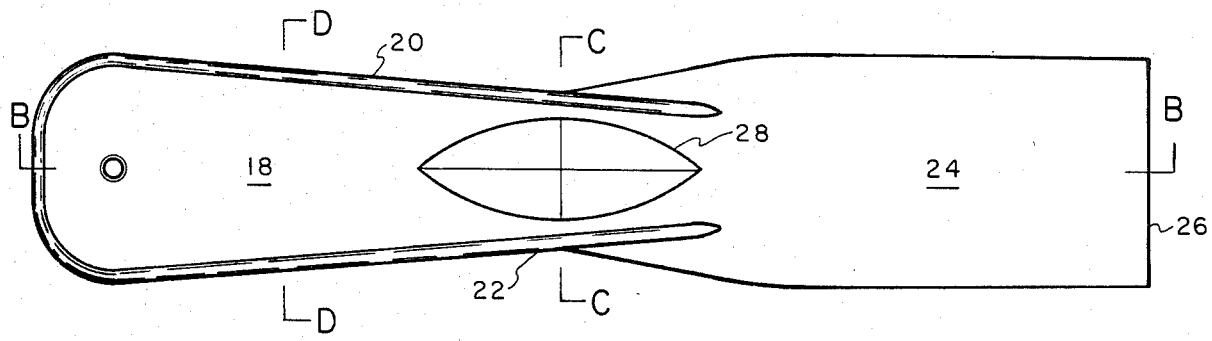
FIG. 2A
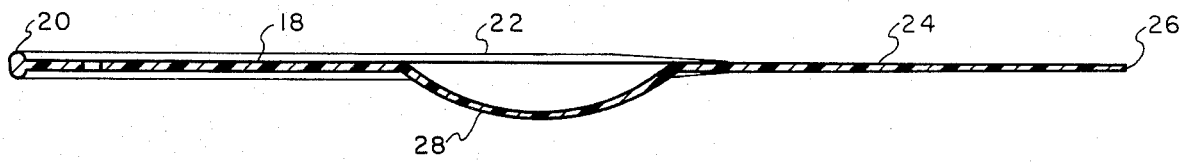
FIG. 2B
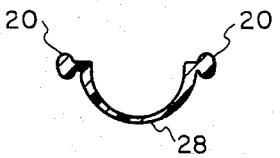
FIG. 2C
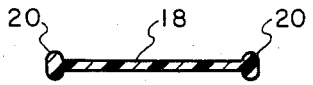
FIG. 2D

SPATULA TYPE HAND TOOL

BACKGROUND OF THE INVENTION

1. Field of the Invention

The present invention relates most generally to the field of hand tools and more particularly to spatula type implements for applying putty, dry wall taping compound, plaster, adhesives and the like.

2. Description of the Prior Art

Prior to the present invention a variety of spatula type hand tools have been available and generally have a steel blade attached to a wood or plastic handle. The size and configuration of the blade is determined by the type of use for which the tool is intended; for example, a relatively narrow straight edge blade is used for a putty knife, a relatively wider blade for drywall taping, and a notched edge for spreading adhesives for cove base or mosaic work.

In more recent years spatula type tools have been produced by molding a thermoplastic material. While such tools are less expensive than the previous metal blade variety they exhibit certain shortcomings which limit their utility even as a disposable one-job tool for use by the homeowner. Since the tools in use have a downward pressure applied to the handle, they tend to flex excessively at the transition between the blade and handle and that area becomes a structural failure point. The useful life of the tool is thus a function of the thickness of the plastic material. The production of a truly useful tool therefore requires the use of an excessive amount of material and increases the expense.

OBJECTS AND SUMMARY OF THE INVENTION

From the foregoing discussion it will be understood that among the various objectives of the present invention are:

the provision of a new and improved spatula-type hand tool;

the provision of a tool of the above-described character having improved resistance of flex-induced failure; and the provision of a tool of the above-described character using a minimum amount of material.

These and other objectives of the present invention are efficiently achieved by providing an integrally molded handle and blade having a reinforcing blister molded along the longitudinal axis across the transition between the handle and blade. The handle portion may be of a reduced thickness by providing a peripheral reinforcing ridge extending through the transition area between handle and blade and onto the surface of the blade.

The foregoing as well as other objects, features and advantages of the present invention will become more apparent from the following detailed description taken in conjunction with the appended drawings.

BRIEF DESCRIPTION OF THE DRAWINGS

FIGS. 1A and 1B are top and side views of a molded spatula-type tool in accordance with the prior art.

FIG. 2A is a top view of a molded spatula-type tool in accordance with the principles of the present invention.

FIG. 2B is a longitudinal cross-section view of the tool of FIG 2A at B—B thereof.

FIG. 2C is a transverse cross section view of the tool of FIG. 2A at C—C thereof.

FIG. 2D is a transverse cross-section view of the tool of FIG. 2A at D—D thereof.

DESCRIPTION OF PREFERRED EMBODIMENT

Figure 3:
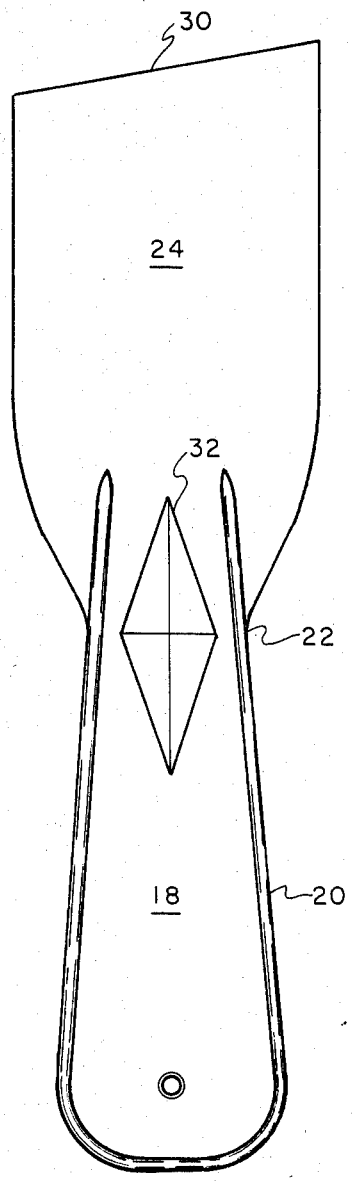
FIG. 3 is a top view of a tool in accordance with the present invention adapted for use as a scraper.

With reference now to FIGS. 1A and 1B there is shown a molded thermoplastic spatula type tool in accordance with the prior art. The tool includes a handle portion 10 of a substantially uniform thickness and a blade portion 12 which is tapered to a working edge 14. As discussed hereinabove in the description of the prior art, the tool of FIGS. 1A and 1B are in use subjected to substantial flexing forces at the transition area 16 between the handle 10 and blade 12. This concentration of flexing forces ultimately produces a structural failure in the transition area 16. The handle portion 10 is of a substantially uniform thickness and therefore consumes an inordinate amount of material to produce a useful tool. By way of example a prior art putty knife has a handle thickness of 0.135 inch and still exhibits a structural inadequacy at the transition from handle to blade.

To overcome the deficiencies of the prior art the Applicant provides a spatula-type tool of the configuration shown in FIG. 2A. The handle portion 18 is provided with a peripheral reinforcing ridge 20 which extends through the transition area 22 and onto the surface of the blade portion 24 which is tapered to a working edge 26.

The transition area 22 is provided with a compound curved; i.e. curved in both the longitudinal and transverse dimensions, reinforcing blister 28. In actual practice of his invention the Applicant has found the ellipsoidal shaped blister shown to be preferred; however, it is to be noted that any polyhedron shaped blister; i.e. three or more surfaces whose intersections meet in a vertex, could be employed. A polyhedron having an infinite number of surfaces is, of course, a hemisphere which is also useful. By use of the ellipsoid shape the reinforcing blister 28 may be conveniently extended through the transition area 22 and onto the surfaces of the handle 18 and blade 24. In each instance the apex or vertex of the reinforcing blister is substantially on the longitudinal axis of the tool and within the transition area 22. In addition to the structural reinforcing function served by the blister 28, it also provides a convenient receptacle for the user's thumb or forefinger when the tool is used in heavier applications.

FIGS. 2B and 2C are longitudinal and transverse cross-section views respectively of the tool of FIG. 2A wherein like elements are identified by like reference characters. In the preferred embodiment the compound curved reinforcing blister 28 is of a thickness which is relatively less at the crown or apex than at the base thereof. This feature permits the stacking of multiple tools, one upon another, in a minimum of space. FIG. 2D is a transverse cross-section view of the handle portion 18 of the tool of FIG. 2A illustrating the peripheral reinforcing ridge 20. In practicing the invention it has been found that a handle portion 18 having a thickness of between 0.050–0.060 inch when provided with the reinforcing ridge 20 permits a reduction in material required by approximately 60% while maintaining structural integrity which is improved over that of the prior art.

Figure 4:
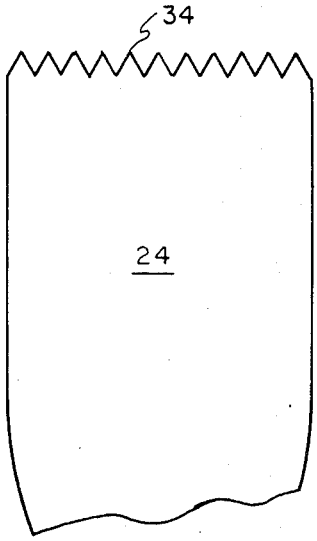
FIG. 4 is a partial top view of the blade portion of a tool in accordance with the present invention adapted as an adhesive spreader.

FIG. 3 is a top view of an embodiment of the present invention adapted for use as a scraper and wherein like elements are identified by like reference characters. The working edge 30 is tapered and the reinforcing blister 32 is illustrated in an alternative embodiment of a four sided polyhedron. FIG. 4 is a partial top view of an embodiment of the invention having a serrated working edge 34 and thus adapted as an adhesive spreader such as for use in installing cove base or ceramic mosaic.

Figure 5:
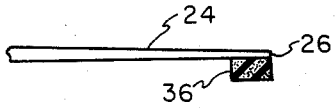
FIG. 5 is a partial side view of the blade portion of an embodiment of the invention adapted as a squeegee.

FIG. 5 illustrates an embodiment of the present invention adapted for use as a squeegee or as a grout float for repairing ceramic tile work. The working edge 26 of blade 24 may be provided at either or both sides with a strip of sponge type material 36 such as, for example, neoprene rubber.

From the foreging it will be understood that the Applicant has provided an economical spatula-type hand tool which efficiently overcomes the deficiencies of the prior art. Since certain changes in the above-described construction will occur to those skilled in the art without departure from the scope of the invention it is intended that all matter contained in the above-description or shown in the appended drawings shall be interpreted as illustrative and not in a limiting sense.

Having described what is new and novel and desired to secure by Letters Patent, what is claimed is:

1. An improved spatula type hand tool of the character having an integrally formed handle portion and blade portion with a transition area therebetween and wherein said improvement comprises, a reinforcing blister having a compound curved configuration with an apex disposed substantially on the longitudinal axis of said tool, across said transition area, extending at opposite ends thereof into said handle and blade portions respectively, and of a thickness which is relatively less at said apex than at the base thereof.

2. A tool as defined in claim 1, wherein said compound curved configuraion is a hemisphere.

3. A tool as defined in claim 1, wherein said compound curved configuration is an ellipse having a major axis disposed along the longitudinal axis of said tool.

4. A tool as defined in claim 1, further including a reinforcing ridge integrally formed at the periphery of said handle portion, extending through said transition area and extending into said blade portion.

5. A tool as defined in claim 1, wherein the end of said blade portion opposite said handle portion is serrated in a predetermined pattern.

6. A tool as defined in claim 1 further including at least one strip of sponge-type material disposed transversely across the end of said blade portion opposite said handle portion.

* * * * *